US009942674B2

(12) United States Patent
Baur et al.

(10) Patent No.: US 9,942,674 B2
(45) Date of Patent: Apr. 10, 2018

(54) METHOD FOR OPERATING A HEARING DEVICE AS WELL AS A HEARING DEVICE

(71) Applicant: Sonova AG, Stafa (CH)

(72) Inventors: Robert Baur, Mannedorf (CH); Gavin Buddis, Zurich (CH); Stefan Pislak, Stafa (CH); Oliver Frank, Hombrechtikon (CH); Ullrich Sigwanz, Hombrechtikon (CH); Shin-Shin Hobi, Lachen (CH)

(73) Assignee: SONOVA AG, Stafa (CH)

( * ) Notice: Subject to any disclaimer, the term of this patent is extended or adjusted under 35 U.S.C. 154(b) by 0 days.

(21) Appl. No.: 14/899,198

(22) PCT Filed: Jun. 25, 2013

(86) PCT No.: PCT/EP2013/063221
§ 371 (c)(1),
(2) Date: Dec. 17, 2015

(87) PCT Pub. No.: WO2014/206446
PCT Pub. Date: Dec. 31, 2014

(65) Prior Publication Data
US 2016/0150332 A1 May 26, 2016

(51) Int. Cl.
*H04R 25/00* (2006.01)
*H04R 3/00* (2006.01)

(52) U.S. Cl.
CPC ..... *H04R 25/75* (2013.01); *H04R 3/007* (2013.01); *H04R 25/48* (2013.01); *H04R 2225/61* (2013.01)

(58) Field of Classification Search
CPC ..... H04R 25/75; H04R 3/007; H04R 25/48; H04R 2225/61
USPC ..... 381/316
See application file for complete search history.

(56) References Cited

U.S. PATENT DOCUMENTS 5,500,902 A * 3/1996 Stockham, Jr. ..... H03G 9/005 381/106
8,005,246 B2 * 8/2011 Ribic ..... H04R 25/35 381/316
8,180,081 B2 * 5/2012 Lunner ..... H04R 25/453 381/312

(Continued)

OTHER PUBLICATIONS

International Search Report for PCT/EP2013/063221 dated Aug. 20, 2013.

(Continued)

*Primary Examiner* — Sean H Nguyen
(74) *Attorney, Agent, or Firm* — Pearne & Gordon LLP

(57) ABSTRACT

A method for operating a hearing device for a user having tinnitus includes converting an acoustic input signal into a corresponding converted input signal, applying a transfer function to the converted input signal for generating a processed input signal, generating a stimulation signal depending on characteristics of a perceived disturbing internal signal resulting from a tinnitus perceived by a prospective user of the hearing device, limiting the stimulation signal by applying a predefined limiting scheme thereby generating a limited stimulation signal, superimposing the limited stimulation signal onto the processed signal thereby generating an output signal, and feeding the output signal to an output transducer for generating a hearing device output signal.

14 Claims, 1 Drawing Sheet

(56) References Cited

U.S. PATENT DOCUMENTS

| | | | | |
|---|---|---|---|---|
| 2004/0264721 | A1* | 12/2004 | Allegro | H04R 25/353 381/316 |
| 2009/0074206 | A1* | 3/2009 | Bradford | H03G 3/32 381/103 |
| 2010/0158262 | A1 | 6/2010 | Schumaier | |
| 2011/0046435 | A1 | 2/2011 | Jensen | |
| 2012/0014553 | A1* | 1/2012 | Bonanno | H03G 3/341 381/364 |
| 2012/0057726 | A1* | 3/2012 | Van Wijngaarden | H03G 7/002 381/107 |

OTHER PUBLICATIONS

Written Opinion International Search Report for PCT/EP2013/063221 dated Aug. 20, 2013.

* cited by examiner

METHOD FOR OPERATING A HEARING DEVICE AS WELL AS A HEARING DEVICE

TECHNICAL FIELD OF THE INVENTION

The present invention is related to a method for operating a hearing device for a user having tinnitus, as well as to a corresponding hearing device.

DESCRIPTION OF THE RELATED ART

Tinnitus is the perception of a sound (also referred to as "internal" sound) in the absence of a corresponding external sound. It gets typically described as a ringing noise.

Tinnitus is treated by so-called masking or a tinnitus retaining therapy. Both treatments involve the usage of an external sound source. The idea is to divert the attention away from the annoying and disturbing "internal" sound by presenting an external signal.

It is an object of the present invention to provide a method for treating tinnitus by using a hearing device.

SUMMARY OF THE INVENTION

It is pointed out that the term "hearing device" must be understood in connection with the present invention as a device to improve the hearing of a user. The user may be hearing impaired or may have a normal hearing. For hearing impaired users, the hearing device might be used to compensate for the hearing loss. The hearing device may be of the type BTE—(Behind-the-ear), ITE—(In-the-ear), CIC—(Completely-in-the-canal) or any other type known today, in particular a hearing device may also be implantable in full or in part. In addition, a hearing device may also be a tinnitus generator unit, by which only a stimulation signal is generated that is used to divert the attention of the hearing device user from the annoying and disturbing sound.

The present invention is directed to a method for operating such a hearing device for a user having tinnitus. The inventive method comprises the steps of:

- generating a stimulation signal depending on characteristics of a perceived disturbing internal signal resulting from a tinnitus perceived by a prospective user of the hearing device,
- limiting the stimulation signal by applying a predefined limiting scheme thereby generating a limited stimulation signal, and
- feeding the limited stimulation signal to an output transducer for generating a hearing device output signal.

This embodiment of the present invention is directed to a tinnitus generator that only generates the stimulation signal. By limiting the stimulation signal applying a predefined limiting scheme allows to take care of a number of issues, for example a too high output levels for the output amplifier of the hearing device. In addition, the limiting scheme may comprise complementary rules that protect the hearing device user from over-stimulation. Therewith, undesirable noise or sound levels are prevented beside the limits imposed by the output stage of the hearing devices, which would affect the stimulation signal.

In addition, the present invention allows preventing stimulation signals that are either potentially harmful for the ear or sound unpleasantly. This can be implemented for all possible user settings, including volume control, for example.

An embodiment of the present invention further comprises the steps of:

- converting an acoustic input signal into a corresponding converted input signal,
- applying a transfer function to the converted input signal for generating a processed input signal, and
- superimposing the processed signal onto the limited stimulation signal before generating the hearing device output signal.

The present invention describes a means of ensuring that given limits are observed without negatively affecting regular sound processing performed in the hearing device for improving the hearing of the hearing device user.

By limiting the stimulation signal applying a predefined limiting scheme allows to take care of a number of issues resulting of superimposing of a signal onto the processed input signal, such as artifacts, too high output levels for the output amplifier of the hearing device to mention just a few. In addition, the limiting scheme may comprise complementary rules that protect the hearing device user from over-stimulation. Therewith, undesirable noise or sound levels are prevented beside the limits imposed by the output stage of the hearing devices, which would affect both, processed input signal and stimulation signal.

In addition, the present invention allows preventing stimulation signals that are either potentially harmful for the ear or sound unpleasantly. This can be implemented for all possible user settings, including volume control and all available hearing programs.

In further embodiments of the present invention, the limiting scheme follows one or a combination of criterions listed below:

- limiting the stimulation signal in order that a maximum hearing device output is not exceeded;
- limiting the stimulation signal such that the output signal is below a predefined level;
- limiting the stimulation signal such that no artifact is obtained in the hearing device output signal;
- limiting the stimulation signal to a predefined maximum level;
- limiting the stimulation signal in dependence on a prospective duration of superimposing the limited stimulation signal onto the processed input signal.

Further embodiments of the present invention comprise the step of manually adjusting the stimulation signal.

In still further embodiments of the present invention, at least one of a level of the stimulation signal and a frequency of the stimulation signal is/are manually adjusted.

Further embodiments of the present invention comprise the steps of:

- transforming the input signal from time domain into frequency domain,
- transforming the output signal from the frequency domain into the time domain, and
- implementing all steps in-between the above-mentioned steps in the frequency domain.

In addition, the present invention is also directed to a hearing device for a user having tinnitus. The inventive hearing device comprises:

- a generator unit for generating a stimulation signal,
- a limiting unit for limiting the stimulation signal received from the generator unit, the limiting unit generating a limited stimulation signal, and
- an output transducer receiving the limited stimulation signal and generating a hearing device output signal, wherein the stimulation signal is limited according to a predefined limiting scheme.

An embodiment of the hearing device according to the present invention further comprises:

an input transducer, a transfer function unit for generating a processed input signal, and a superposition unit for superimposing the processed input signal onto the limited stimulation signal, wherein the input transducer is operatively connected to the transfer function unit, and wherein the transfer function unit is operatively connected to the superposition unit.

In further embodiments of the hearing device according to the present invention, the limiting scheme follows one or a combination of criterions listed below:

limiting the stimulation signal in order that a maximum hearing device output is not exceeded;

limiting the stimulation signal such that the output signal is below a predefined level;

limiting the stimulation signal such that no artifact is obtained in the hearing device output signal;

limiting the stimulation signal to a predefined maximum level;

limiting the stimulation signal in dependence on a prospective duration of superimposing the limited stimulation signal onto the processed input signal.

Further embodiments of the hearing device according to the present invention further comprise a control unit for manually adjusting the stimulation signal, the control unit being wirelessly connectable to an input unit comprising input means for a user.

In further embodiments of the hearing device according to the present invention at least one of a level of the stimulation signal and a frequency of the stimulation signal is/are manually adjustable.

Still further embodiments of the hearing device according to the present invention comprise:

a transform unit for transforming the input signal from time domain into frequency domain, and an inverse transform unit for transforming the output signal from the frequency domain into the time domain.

It is expressly pointed out that also all combinations of the above-mentioned embodiments are possible and herewith disclosed. Only those embodiments or combinations of embodiments are excluded that would result in a contradiction.

BRIEF DESCRIPTION OF THE DRAWING

An embodiment of the present invention is hereinafter described by way of example referring to drawings showing exemplified embodiments.

DETAILED DESCRIPTION OF THE INVENTION

Figure 1:
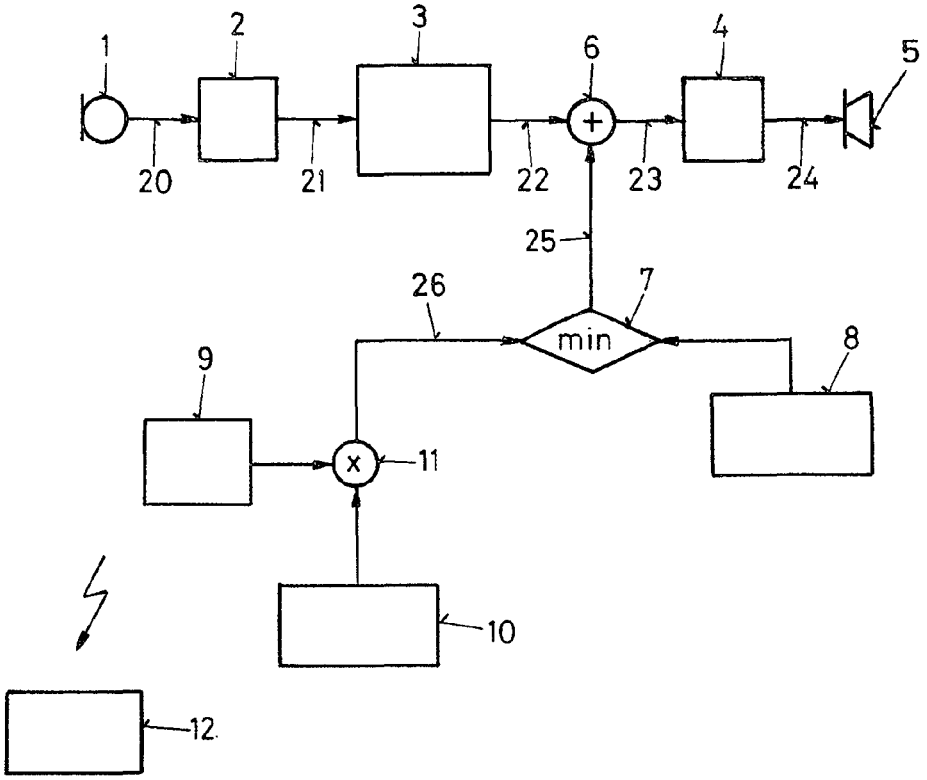
FIG. 1 shows a schematic block diagram of a first embodiment of a hearing device according to the present invention.

FIG. 1 shows a block diagram of a hearing device according to the present invention. The hearing device comprises an input transducer 1, a first transform unit 2, a transfer function unit 3, a second transform unit 4 and an output transducer 5. These components being standard components are interconnected in series according to the sequence they have been mentioned above. The input transducer 1 picks up an acoustic signal and converts it into a (electrical) input signal 20 that is fed to the first transform unit 2 transforming the input signal 20 from time domain into frequency domain. Accordingly, the input signal 21 being processed in the transfer function unit 3 is in the frequency domain as well as a processed input signal 22 that results after processing the input signal 21 in the transfer function unit 3. While in a known hearing device the processed input signal 22 is directly fed to the second transform unit 4 in order to transform it from the frequency domain back into the time domain for feeding it to the output transducer 5, the hearing device according to the present invention additionally comprises components for implementing the tinnitus functionality comprising a generator unit 10, a control unit 9, a multiplier 11, a limit adjusting unit 8, a limiting unit 7 and a superposition unit 6, the latter being positioned in the standard signal processing path between the transfer function unit 3 and the second transform unit 4, as it is depicted in FIG. 1.

A frequency shaped noise signal is generated by the generator unit 10 generating the source signal for treating the tinnitus. The level of this source signal can be modified by the user via the control unit 9 by adjusting the level of the source signal via multiplier 11, for example, also called tinnitus volume control. The resulting signal is then limited by a dedicated limiting unit 7.

The control unit 9 can be implemented in the housing of the hearing device, an input element (not shown in FIG. 1) being directly accessible by the user from the outside.

In a further embodiment of the present invention, an input unit 12 is provided that is separated from the hearing device using. The input unit 12 may be, for example, an accessory device having input elements that open up the opportunity to enter control commands by the user in order to adjust settings in the hearing device, in particular to alter amplitude and/or frequency of the stimulation signal. In addition, the limiting scheme can also be adapted or another predefined limiting scheme can be selected, respectively.

As it is indicated in FIG. 1, the input unit 12 and the control unit 9 are wirelessly interconnected, for example.

The limit applied in the limiting unit 7 is generated in the limit adjusting unit according to one or a combination of several of the following criterions:

The limited stimulation signal 25 should not exceed the maximum hearing device output for amplified sounds (MPO—Maximum Power Output).

Generally, a maximum exposure to noise of 85 dB (A) in the free field for a period of eight hours should not be exceeded. Further incrementing the noise by 3 dB requires the halving of the exposure time while decrementing the noise by 3 dB would allow the doubling of the exposure time. It is anticipated that the tinnitus treatment according to the present invention will be running for rather long time periods, thus the recommended maximum exposure limits will have to be considered when fitting the hearing device. During 'normal' operation of the hearing device, i.e. without tinnitus treatment, these limits are less of an issue since the exposure to loud sounds is typically rather short-timed. Thus typically lower limits for the stimulation signal 26 than for the processed input signal 22 are required.

The limited stimulation signal 25 should remain below a hearing device dependent limit to keep the output signal of the hearing device artefact free (i.e. free of crackling).

The limit applied in the limiting unit 7 depends on the selected hearing program in the hearing device, the hearing program being a specific algorithm applied in the transfer function unit 3 that best suites a prevailing acoustic surrounding.

The limit applied in the limiting unit 7 is typically lower than the maximum power output (MPO) applied to the input signal 20 resulting from the input transducer 1. The limited stimulation signal 25 is then added to the processed output signal 22 in the superposition unit 6 just before the second transform unit 4.

As already mentioned, the processing of the input signal 20 is implemented in the frequency domain. Accordingly, the first and the second transform units 2 and 4 are present in the embodiment depicted in FIG. 1. The transform units 2 and 4 can be realized by any transformation and corresponding inverse transformation, such as the commonly known Fourier and inverse Fourier transforms. However, the processing can also take place in the time domain. In such an embodiment, the first and the second transform units 2 and 4 are obviously not necessary.

In still further embodiments, the first and the second transform units 2 and 4 may be arranged at different positions in the signal path resulting in an adapted signal processing scheme. Moving the first transform unit 2, for example, down the signal path such that the transfer function unit 3 is arranged in between the input transducer 1 and the first transform unit 2, results in applying the processing steps in the transfer function unit 3 in the time domain. It is pointed out that other arrangements of the first and the second transform units 2 and 4 are feasible, and are obvious to implement by the skilled artisan.

The present invention describes a mean to ensure the limits mentioned above for all possible user settings, including but not limited to volume control and hearing program selection, without affecting regular sound processing.

Figure 2:
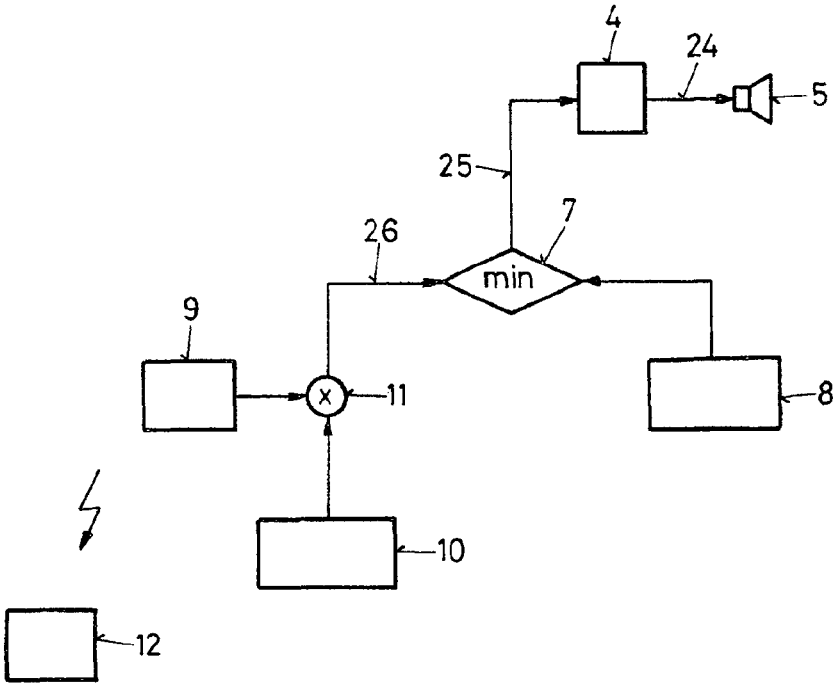
FIG. 2 shows a schematic block diagram of a second embodiment of a hearing device according to the present invention.

FIG. 2 shows a schematic block diagram of a further embodiment of the present invention. In contrast to the block diagram of FIG. 1, FIG. 2 shows a hearing device that functionally only serves the purpose of a tinnitus generator unit. Accordingly, the input transducer 1, the first transform unit 2, the transfer function unit 3 and the superposition unit 6 comprised in the embodiment of FIG. 1 cannot be found in the embodiment depicted in FIG. 2. All other components of the embodiment depicted in FIG. 1 can also be found in the embodiment depicted in FIG. 2. It is expressly pointed out that all components depicted in FIG. 2 may perform the same function as have been described in connection with the embodiment of FIG. 1. In addition, with regard to the components depicted in FIG. 2, also all further embodiments—and its sub-combinations—described in connection with FIG. 1 can also be validly implemented in the embodiment of FIG. 2.

What is claimed is:

1. A method for operating a hearing device for a user having tinnitus, the method comprising the steps of:

generating a stimulation signal depending on characteristics of a perceived disturbing internal signal resulting from a tinnitus perceived by a prospective user of the hearing device, limiting the stimulation signal by applying a predefined limiting scheme thereby generating a limited stimulation signal, converting an acoustic input signal into a corresponding converted input signal, applying a transfer function to the converted input signal for generating a processed input signal, superimposing the processed input signal onto the limited stimulation signal before generating the hearing device output signal, and feeding the superimposed processed input signal with the limited stimulation signal to an output transducer for generating a hearing device output signal, wherein the limiting scheme follows one or a combination of criterions listed below:

limiting the stimulation signal in order that a maximum hearing device output is not exceeded;

limiting the stimulation signal such that the output signal is below a predefined level;

limiting the stimulation signal such that no artifact is obtained in the hearing device output signal;

limiting the stimulation signal to a predefined maximum level;

limiting the stimulation signal in dependence on a prospective duration of superimposing the limited stimulation signal onto the processed input signal.

2. The method of claim 1, further comprising the step of manually adjusting the stimulation signal.

3. The method of claim 2, wherein at least one of a level of the stimulation signal and a frequency of the stimulation signal is/are manually adjusted.

4. The method of claim 1, further comprising the steps of:

transforming the input signal from a time domain into a frequency domain, transforming the output signal from the frequency domain into the time domain, and implementing in the frequency domain the steps of: generating the stimulation signal, limiting the stimulation signal, and feeding the limited stimulation signal to the output transducer.

5. The method of claim 1, wherein applying the predefined limiting scheme comprises ensuring that the limited stimulation signal does not exceed a predefined limit.

6. The method of claim 1, wherein applying the predefined limiting scheme comprises comparing the stimulation signal to a cutoff value, and, if the stimulation signal exceeds the cutoff value, setting the limited stimulation signal to the cutoff value.

7. The method of claim 6, wherein the cutoff value is a predefined cutoff value.

8. A hearing device for a user having tinnitus, the hearing device comprising:

a generator unit for generating a stimulation signal, a limiting unit for limiting the stimulation signal received from the generator unit, the limiting unit generating a limited stimulation signal, an input transducer, a transfer function unit for generating a processed input signal, and a superposition unit for superimposing the processed input signal onto the limited stimulation signal, and an output transducer receiving the superimposed processed input signal with the limited stimulation signal and generating a hearing device output signal, wherein the input transducer is operatively connected to the transfer function unit, and wherein the transfer function unit is operatively connected to the superposition unit, wherein the stimulation signal is limited according to a predefined limiting scheme, and wherein the limiting scheme follows one or a combination of criterions listed below:

limiting the stimulation signal in order that a maximum hearing device output is not exceeded;

limiting the stimulation signal such that the output signal is below a predefined level;

limiting the stimulation signal such that no artifact is obtained in the hearing device output signal;

limiting the stimulation signal to a predefined maximum level;

limiting the stimulation signal in dependence on a prospective duration of superimposing the limited stimulation signal onto the processed input signal.

9. The hearing device of claim 8, further comprising a control unit for manually adjusting the stimulation signal, the control unit being wirelessly connectable to an input unit comprising input means for a user.

10. The hearing device of claim 9, wherein at least one of a level of the stimulation signal and a frequency of the stimulation signal is/are manually adjustable.

11. The hearing device of claim 8, further comprising:

a transform unit for transforming the input signal from time domain into frequency domain, and an inverse transform unit for transforming the output signal from the frequency domain into the time domain.

12. The hearing device of claim 8, wherein the limiting unit generates the limited stimulation signal in such a way that the limited stimulation signal does not exceed a predefined limit.

13. The hearing device of claim 8, wherein the limiting unit generates the limited stimulation signal by comparing the stimulation signal to a cutoff value, and, if the stimulation signal exceeds the cutoff value, setting the limited stimulation signal to the cutoff value.

14. The hearing device of claim 13, wherein the cutoff value is a predefined cutoff value.

* * * * *